US005250749A

United States Patent [19]

Aimoto

[11] Patent Number: 5,250,749

[45] Date of Patent: Oct. 5, 1993

[54] DEVELOPING UNIT PROVIDED WITH MECHANISM FOR EXHAUSTING DEVELOPING POWDER FROM DEVELOPING UNIT

[75] Inventor: Toyoka Aimoto, Nara, Japan

[73] Assignee: Sharp Kabushiki Kaisha, Osaka, Japan

[21] Appl. No.: 918,493

[22] Filed: Jul. 22, 1992

[30] Foreign Application Priority Data

Feb. 19, 1992 [JP] Japan ..... 4-031839
Apr. 24, 1992 [JP] Japan ..... 4-106447

[51] Int. Cl.[5] ..... G03G 15/08
[52] U.S. Cl. ..... 118/653; 355/245
[58] Field of Search ..... 355/253, 259, 255, 245; 118/654, 657, 653

[56] References Cited

U.S. PATENT DOCUMENTS 4,451,133 5/1984 Kopp et al. .
4,565,435 1/1986 Hart ..... 118/657 X
4,625,895 12/1986 Tsukano ..... 222/63
4,891,671 1/1990 Iwamasa ..... 355/245
5,025,289 6/1991 Guslits et al. ..... 355/253

FOREIGN PATENT DOCUMENTS 60-153066 8/1985 Japan .

OTHER PUBLICATIONS

Abstract of Japanese Kokai 60-153066, Published Aug. 1985.

*Primary Examiner*—R. L. Moses
*Attorney, Agent, or Firm*—David G. Conlin; George W. Neuner

[57] ABSTRACT

A developing unit is intended to have a capability of efficiently exhausting developing powder. The developing unit is constructed to have a developing bath, one or more rollers for development, an exhausting mechanism for exhausting the developing powder out of the developing bath, a shielding member for shielding the exhausting mechanism from the developing bath or exposing it to the developing bath, and a control unit for controlling the rollers, the exhausting mechanism and the shielding member. When exhausting the developing powder, the control unit operates to drive the rollers and then activate the shielding member for exposing the exhausting mechanism to the inside of the developing bath after a certain time is elapsed since the rollers are driven. Further, a pair of rotary bodies may be provided in parallel for opening or closing the exhaust outlet of the developing bath selectively at a proper time.

7 Claims, 10 Drawing Sheets

DEVELOPING UNIT PROVIDED WITH MECHANISM FOR EXHAUSTING DEVELOPING POWDER FROM DEVELOPING UNIT

BACKGROUND OF THE INVENTION

1. Field of the Invention

The present invention relates to a mechanism for exhausting waste developing powder from a developing unit provided in an image forming apparatus of an electronic photography type.

2. Description of the Related Art

In the image forming apparatus of an electronic photography type, when the number of processed copies reaches several thousands to several hundred thousands, the life of developing powder is expired. This results in degrading the quality of a copied image and bringing about the splash of developing powder to the inside of the main body of the image forming apparatus.

To smoothly remove the waste developing powder, the inventors of the present application know there has been proposed a mechanism for exhausting waste developing powder. In the known mechanism, there is provided a screw for exhausting developing powder. When exhausting the waste developing powder, the exhausting screw is driven to convey the developing powder toward an exhaust outlet.

If the developing unit is left untouched for a long time, it is likely that the developing powder may become solid due to the influence of the circumstance around the powder. The solid developing powder has an inferior fluidity.

However, the known mechanism is not capable of efficiently exhausting the solid developing powder. That is, the exhausting screw does not enable to smoothly move the solid developing powder. This results in consuming a long time until the termination of exhausting the waste developing powder. This long time is wasteful, because no work can be done for the image forming apparatus during the time.

SUMMARY OF THE INVENTION

It is therefore an object of the present invention to provide a developing unit which has improved exhausting efficiency.

The object of the present invention is accomplished by a developing unit according to a first aspect of the invention comprising: a developing bath; one or more rollers disposed in the bath for development; means disposed in the bath below the rollers for exhausting developing powder out of the developing bath through an exhaust outlet; a shielding member for selectively shielding the exhausting means from the developing bath or exposing the means to the developing bath; and a control unit for controlling the rollers, the exhausting means and the shielding member; the control unit having means for driving the rollers when exhausting the developing powder and means for driving the shielding member in a manner to expose the exhausting means to the developing bath after an elapse of a certain time from the initiation of driving the rollers, while driving the exhausting means.

In operation, when exhausting the developing powder, the shielding member is closed in a manner that the rollers and are allowed to rotate as shielding the exhausting member. After a certain time is elapsed, the shielding member is opened as rotating the exhausting member so that the exhausting member may be exposed to the inside of the developing bath.

Since the developing powder is stirred by the rollers 4 and 5, the developing powder has so superior fluidity that the developing powder may be more easily carried by the exhausting member 27. This results in reducing the time consumed in exhausting the developing powder.

The object of the present invention is also accomplished by a developing unit according to a second aspect of the invention comprising: a developing bath having an exhaust outlet formed on the bottom; one or more rollers for development being rotatably fitted to the inside of the developing bath; and means for exhausting developing powder out of the developing bath through the exhaust outlet; the exhausting means including a pair of rotary bodies for carrying the developing powder axially, one rotary body carrying the developing powder in an opposite direction to the other rotary body and facing the exhaust outlet.

In operation, when developing an image, the developing rollers and the first and the second rotary bodies are rotated in concert. At this time, the exhaust outlet is closed.

The developing powder is stirred by the developing rollers and the first and the second rotary bodies. The developing powder being axially carried by the first rotary body is radially transferred by the carrying member of the first body and reaches the second rotary body.

The second rotary body then serves to axially carry the developing powder in an opposite direction to the carrying direction of the second rotary body. The carrying member of the second rotary body serves to move the developing powder in the direction of the first rotary body. That is, the developing powder is kept constantly circulated for stirring in the developing bath.

To exchange the waste developing powder, the exhaust outlet is opened so that the first and the second rotary bodies are rotated. The developing powder is allowed to axially move by means of the first rotary body and reaches the exhaust outlet, through which the developing powder is exhausted out of the developing bath. Then, the new developing powder is fed into the developing bath.

Since the rotary bodies keep the developing powder constantly circulated, the developing powder is not jammed in the bearings of the rotary bodies, resulting in smoothly exhausting the developing powder.

Further objects and advantages of the present invention will be apparent from the following description of the preferred embodiments of the invention as illustrated in the accompanying drawings.

DESCRIPTION OF THE PREFERRED EMBODIMENTS

The description will be directed to a developing unit according to a first embodiment of the present invention as referring to FIGS. 1 to 6.

Figure 1:
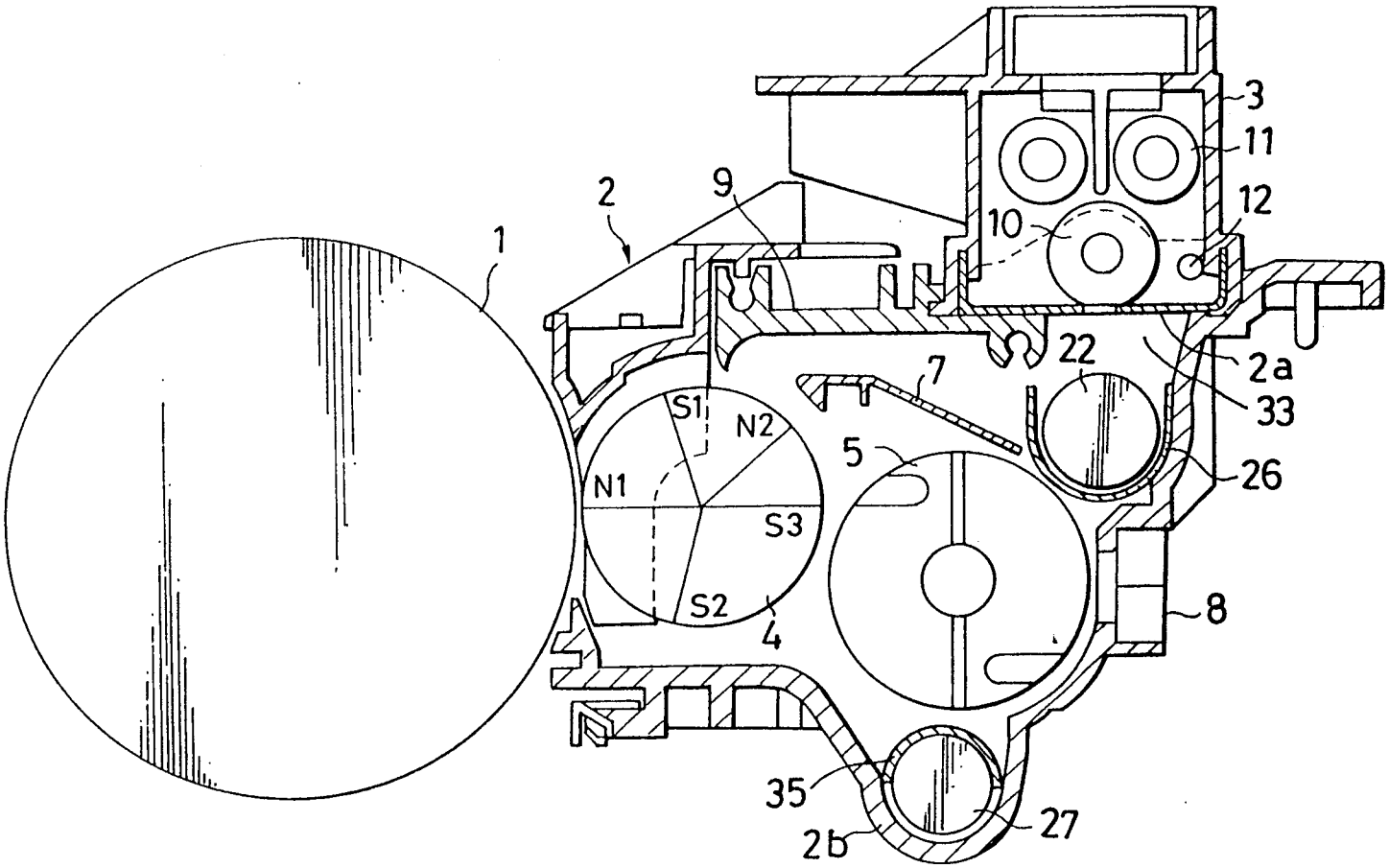
FIG. 1 is a sectional view showing a developing unit according to a first embodiment of the present invention.

FIG. 1 is a sectional view showing the developing unit. As shown, 1 denotes a photosensitive drum 2 denotes a developing bath 3 denotes a toner hopper 4 denotes a magnet roller 5 denotes a stirring roller 7 denotes a flow plate 8 denotes a toner density sensor 9 denotes a doctor 10 denotes a toner feeding roller 11 denotes a toner carrying screw.

Figure 2:
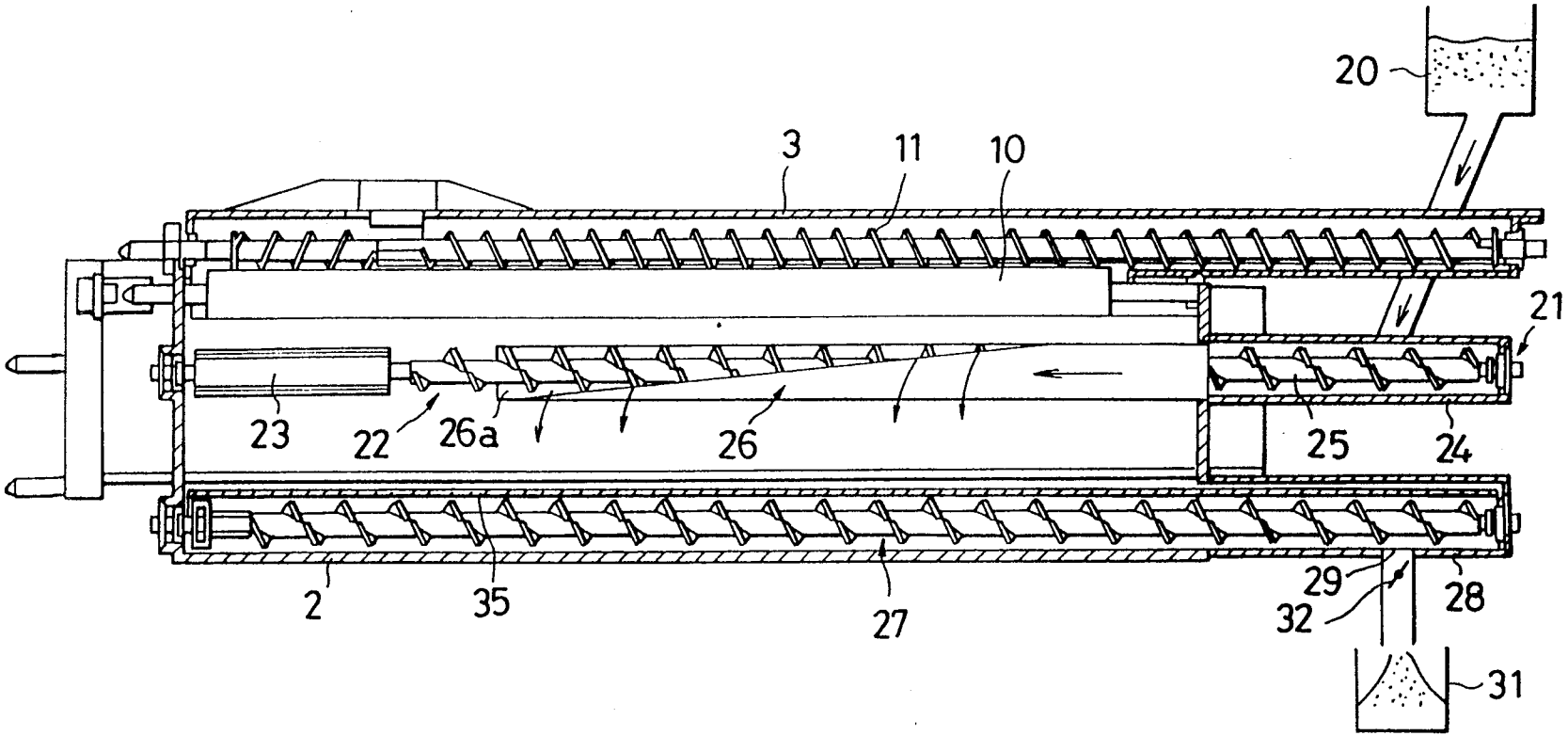
FIG. 2 is a side sectional view showing the developing unit shown in FIG. 1.
Figure 3:
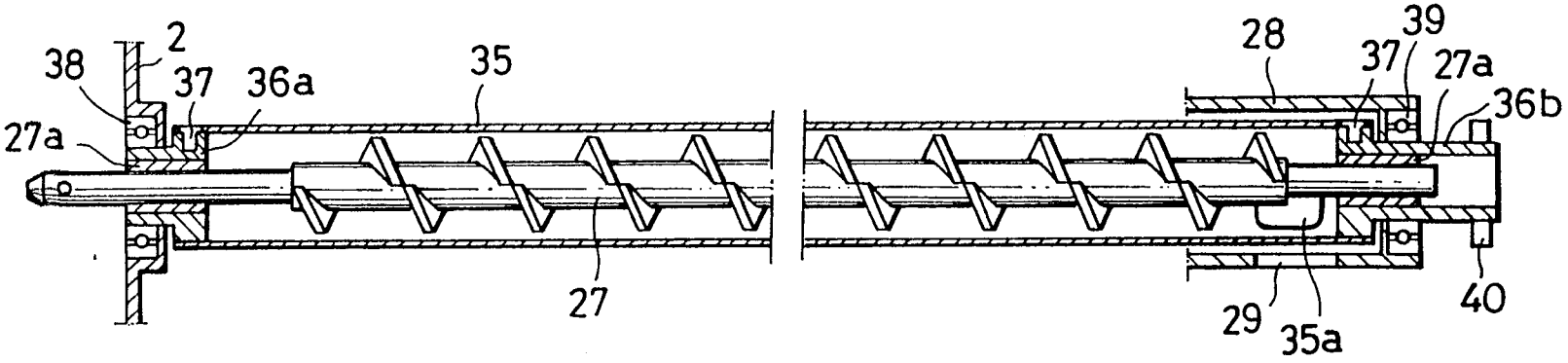
FIG. 3 is a sectional view showing an exhausting mechanism and a shielding member included in the developing unit.
Figure 4:
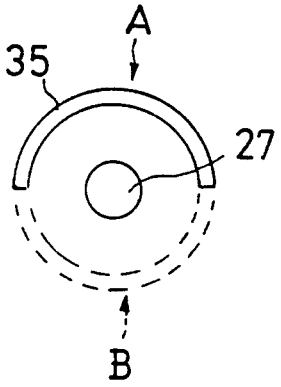
FIG. 4 is a side view showing the shielding member.
Figure 5:
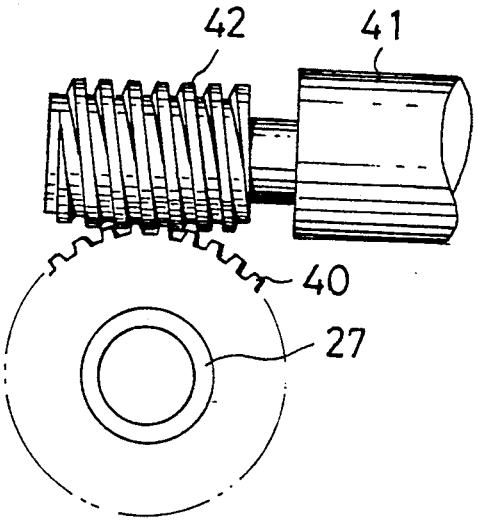
FIG. 5 is a view showing a mechanism for opening or closing the shielding member.
Figure 6:
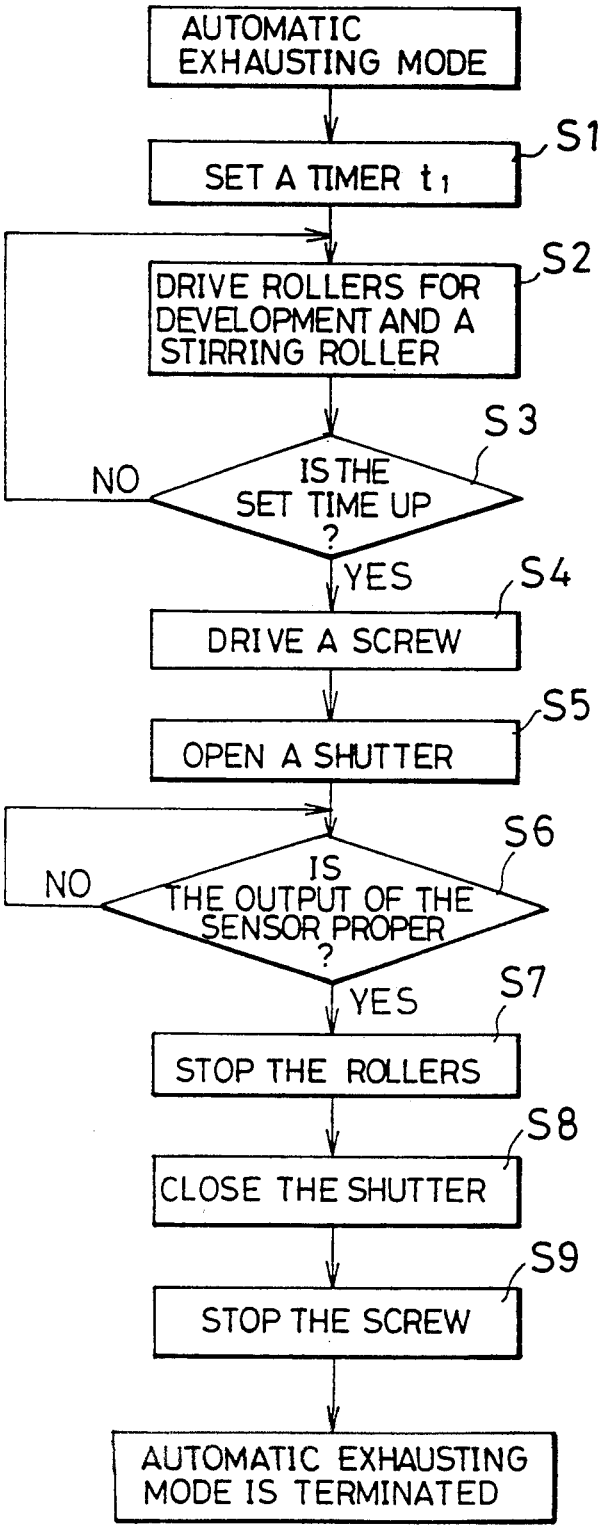
FIG. 6 is a flowchart showing the flow of exhausting developing powder.

Turning to FIG. 2 showing the side of the developing unit 20 denotes a feeding bath for feeding developing powder D into the developing bath 21 denotes a carrying mechanism for carrying the developing powder D in the developing bath 2. The carrying mechanism 21 is composed of a carrying screw 22 and a stirring member 23. The carrying screw 22 serves to carry the developing powder D from one side to the other side of the developing bath 2 along a longitudinal length. The stirring member 23 serves to stir the developing powder D circumferentially at the other side. Herein, one side means the side closer to the front door of the image forming apparatus and the other side means the opposite side thereto.

As shown in FIG. 2, the carrying mechanism 21 is located immediately below an opening 26*a* of the developing bath 2 and in an obliquely upward of the stirring roller 5. As shown in FIG. 2, the carrying screw 22 is inserted into the inside of a cylinder 24 projected on the developing bath 2. The carrying screw 22 is constructed to have a rotary shaft 25 and a spiral plate fitted on the rotary shaft 25. The stirring member 23 is composed of an agitator. The stirring member 23 is mounted on the other side of the rotary shaft 25. Both ends of the rotary shaft 25 are rotatably supported by the developing bath 2 and the cylinder 24, respectively.

The developing powder D being fed from the feeding bath 20 is gradually carried from the entry side of the developing bath 2 (as viewed in the right hand of FIG. 2) to the inner side. Since all the developing powder D is not carried, however, more of the developing powder D is left around the entry part than at the remaining part. That is, the distribution of the developing powder in the developing bath 2 is formed like a mountain whose tip is shifted to the entry side. Hence, the density of the developing powder D is higher around the entry part and gradually becomes lower toward the opposite side, that is, the inner side.

The irregular density of the developing powder D may give rise to an uneven-density image. To make the density even, it is necessary to stir the developing powder D again. Only the carrying screw 22, however, cannot achieve the efficient restirring operation.

To make the density even, there is provided a carrying path 26 surrounding the carrying screw 22. The carrying path 26 has an opening 26*a* progressively increasing from the entry side to the inner side. The carrying path 26 is formed around the carrying screw 22 like a U character in a manner that the opening 26*a* may be directed upward. The wall of the carrying path 26 opposite to the rotating direction of the carrying screw 22 is made gradually lower from the entry side to the inner side.

Below the stirring roller 5 of the developing bath 2, a ditch 2*a* is formed. In the ditch 2*a*, an exhausting screw 27 is located for exhausting the waste developing powder D out of the developing bath 2. Like the carrying means 21, the exhausting screw 27 is inserted into a cylinder 28 projected on the developing bath 2 at the exhaust side. Both ends of the exhausting screw 27 are rotatably supported on the developing bath 2 and the cylinder 28 through a bearing 27*a*.

The feeding bath 20 is connected to the cylinder 24 so that a shutter (not shown) is provided between the cylinder 24 and the feeding bath 20. The bath 20 may selectively communicate with the cylinder 24 if necessary through the effect of a shutter.

The cylinder 28 provides an exhaust outlet 29 formed thereon, which is connected to a waste vessel 31 through an exhaust pipe 30. In the exhaust pipe 30, a shutter 32 is rotatably provided so that the shutter 32 is controlled to close the exhaust outlet 29 when developing an image and open the outlet 29 when exhausting the developing powder.

Like the feeding bath 20, the waste vessel 31 is located at the entry side of the developing unit and can be easily removed from the main body of an image forming apparatus.

The magnet roller 4, the stirring roller 5, the carrying screw 22 and the exhaust screw 27 are rotated by a driving unit such as a motor through gears and coupling mechanisms. The driving unit is located on the opposite side of the developing unit in the image forming apparatus.

Around the exhausting screw 27, there is rotatably provided a shielding member 35. The shielding member 35 serves selectively to shield the exhausting screw 27 from the developing bath 2 or expose it to the developing bath 2. The shielding member 35 is made of a long plate formed like an arc and provided with a hole 35*a* for passing the developing powder. The hole 35*a* is formed on the side of the exhaust outlet 29.

On both of the ends of the shielding member 35, there are press-fitted flanges 36*a* and 36*b*. The shielding member 35 is mounted to the flanges 36*a* and 36*b* through a mechanical screw 37. The flange 36*a* is rotatably supported on the side wall of the developing bath 2 through a bearing 38. The other flange 36*b* is rotatably supported on an exhausting cylinder 28 through a gear 39. The bearings 27*a* of the exhausting screw 27 are fitted in the flanges 36*a* and 26*b*.

The flange 36*b* is projected outwardly from the exhausting cylinder 28. The tip of the flange 36*b* has a gear 40 fixed thereon. The gear 40 is engaged with a worm 42 linked with a motor 41.

The shielding member 35 is switched from a closed posture A to an open posture B or vice versa by the motor 41. In the closed posture A, the shielding member 35 is located to shield an upper half of the exhausting screw 27 for screening the screw 27 from the developing bath 2. In the open posture B, the shielding member 35 is located to shield a lower half of the exhausting screw 27 for exposing the screw 27 onto the developing bath 2. In the open posture B, the exhaust outlet 29 is fitted into the position of the hole 35*a* so that the developing powder is allowed to move through the outlet 29 and the hole 35*a*.

To control the magnet roller 4, the stirring roller 5, the exhausting screw 27, and the shielding member 35, a control unit composed of a microcomputer is provided on the main body of an image forming apparatus.

The control unit provides three functions, one function for driving the rollers 4, 5 and stopping the carrying screw 22 when developing an image, one function of stirring the developing powder by driving the rollers 4 and 5 when exhausting the waste developing powder D, and the other function of driving the exhausting screw 27 when a certain time is passed after the rollers 4 and 5 are driven and driving the motor 41 for switching the shielding member 35 to the open posture B.

The mode for automatically exhausting the developing powder is started by switching an operation key for exchanging the developing powder D.

In the foregoing construction, consider that the automatic exhausting mode is executed for exhausting the waste developing powder D. At first, a timer t1 is set (step 1) so that the magnet roller 4 and the stirring roller 5 are driven for a predetermined time (step 2). With this function, the developing powder is stirred so as to make the developing powder more fluid in the developing bath 2.

After the developing powder is stirred for a time set by the timer t1 (step 3), the exhausting screw 27 is rotated (step 4) and concurrently the motor 41 is activated so that the shielding member 35 may be put into the open posture A (step 5).

The developing powder is carried toward the arrow C by means of the exhausting screw 27 and then drop from the hole 35*a* of the shielding member 35 to the exhaust outlet 29, through which the developing powder is guided into the waste vessel 31.

As the developing powder is being exhausted from the developing bath 2, the output of the permeability sensor 8 served as a toner density sensor is made variable. On the output data of the sensor 8, the exhausting state of the developing powder is determined.

When the sensor 8 produces zero output, it indicates that the exhaust of the developing powder is terminated. At this time, the magnet roller 4 and the stirring roller 5 are deactivated (step 7), so that the shielding member 35 may be put into the closed posture A (step 8). Then, the rotation of the exhausting screw 27 is stopped (step 9). This is the end of the operation of automatically exhausting the waste developing powder.

To feed the new developing powder D, as the shield member 35 stays at the closed posture A, the shutter for the developing powder feeding bath is opened so that the developing powder D flows from the feeding bath 20 into the cylinder 24.

By driving the rollers 4, 5 and the carrying screw 22, the developing powder is allowed to move from the entry side to the inner side by means of the carrying screw 22.

The developing powder D overflown out of the opening 26*a* is progressively increased from the entry side to the inner side. Hence, the distribution of the developing powder D is not shifted toward the entry side. It means that no special stirring operation is required for feeding the developing powder uniformly. Then, the stirring roller 5 serves to charge the developing powder D in the developing bath 2.

The carrying screw 22 is used for carrying the developing powder D from the entry side to the inner side and provides excellent carrying efficiency. The extension of the carrying screw 22 to the tip of the rotary shaft 25 results in constantly moving the developing powder D in the B direction, thereby making the height of the developing powder D in the developing bath 2 irregular, which makes the toner density variable. Hence, the resulting copying image may be degraded.

To prevent the disadvantageous phenomenon, the stirring member 23 is provided on the inner side. This stirring member 23 provides no capability of carrying the developing powder in the B direction but a more excellent capability of stirring the developing powder radially than the carrying screw 22. Hence, the developing powder D is carried toward the inner side by the carrying screw 22 and is diffused radially by means of the stirring member 23 for the purpose of keeping the density of the developing powder D uniform in the developing bath 2.

When developing an image, the rollers 4, 5 and the carrying screw 22 are rotated and the shielding member 35 stays at the closed posture A so that the exhausting screw 27 is not exposed onto the inside of the developing bath 2. Hence, the developing powder stored in the bottom of the developing bath 2 is not left around the bearing of the exhausting screw 27. This results in preventing the developing powder from being jammed in the exhaust outlet 29, that is, the bearing 27*a* from being locked by the developing powder.

As described above, before exhausting the developing powder, this embodiment makes it possible to sufficiently stir the developing powder for making the developing powder more fluid before doing the exhausting operation. This results in reducing the exhausting time, that is, the time when the image forming apparatus is stopped, which gives less inconvenience to the user.

In addition, the exhausting member may employ another means except the screw. The shielding member is not limited to a shutter formed like an arc. It may be a tabular plate moving in the horizontal direction.

In turn, the description will be directed to the developing unit according to a second embodiment of the present invention. Before the description thereabout, however, the related art known by the inventors of the present application will be described for deeper and easier understanding of the second embodiment as referring to FIGS. 7 and 8.

As is obvious from the comparison between FIGS. 1 and 2 and FIGS. 7 and 8, the related art has the same components as the first embodiment and thus those components have the same reference numbers.

Figure 7:
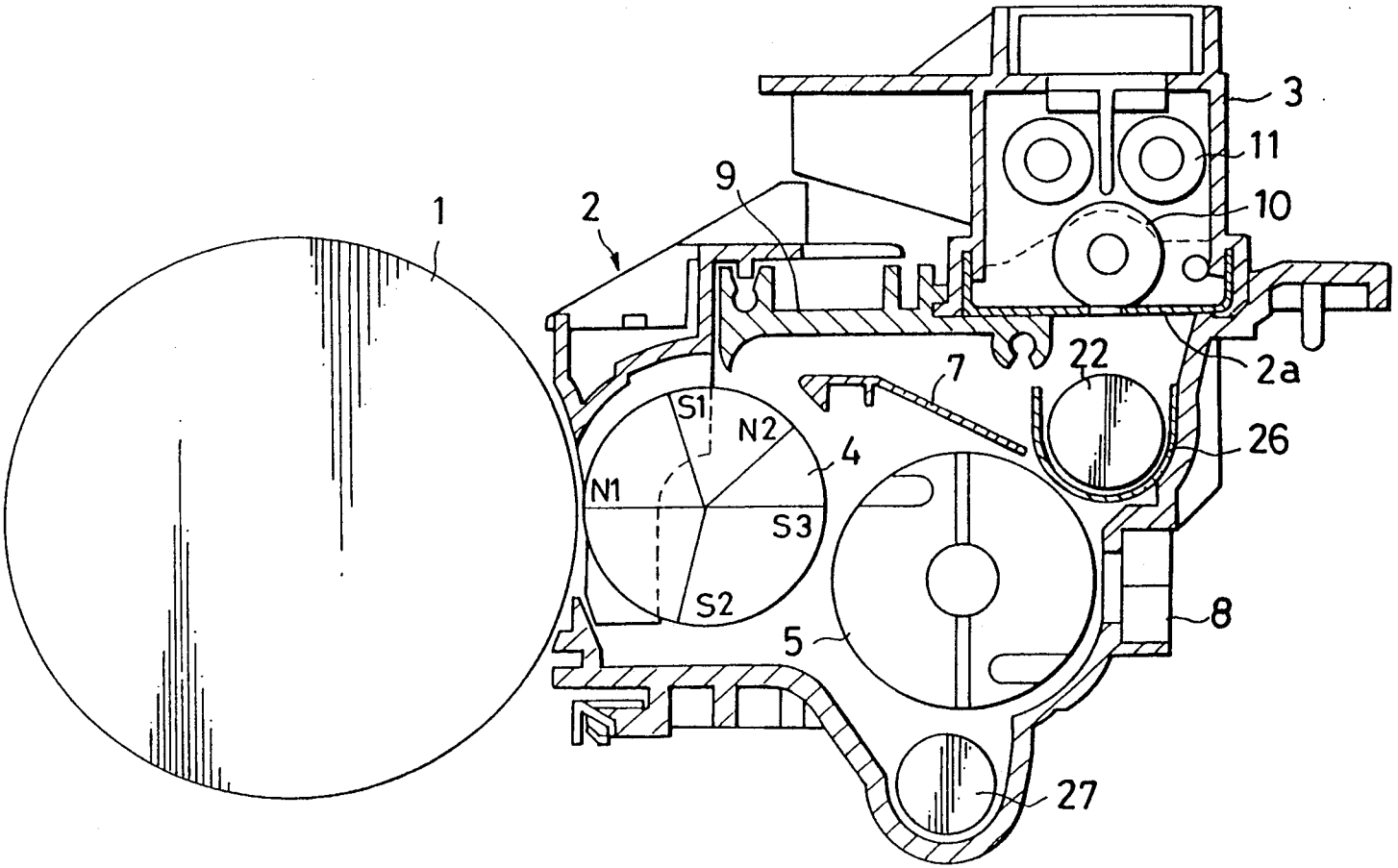
FIG. 7 is a sectional view showing a developing unit according to the related art of the invention.
Figure 8:
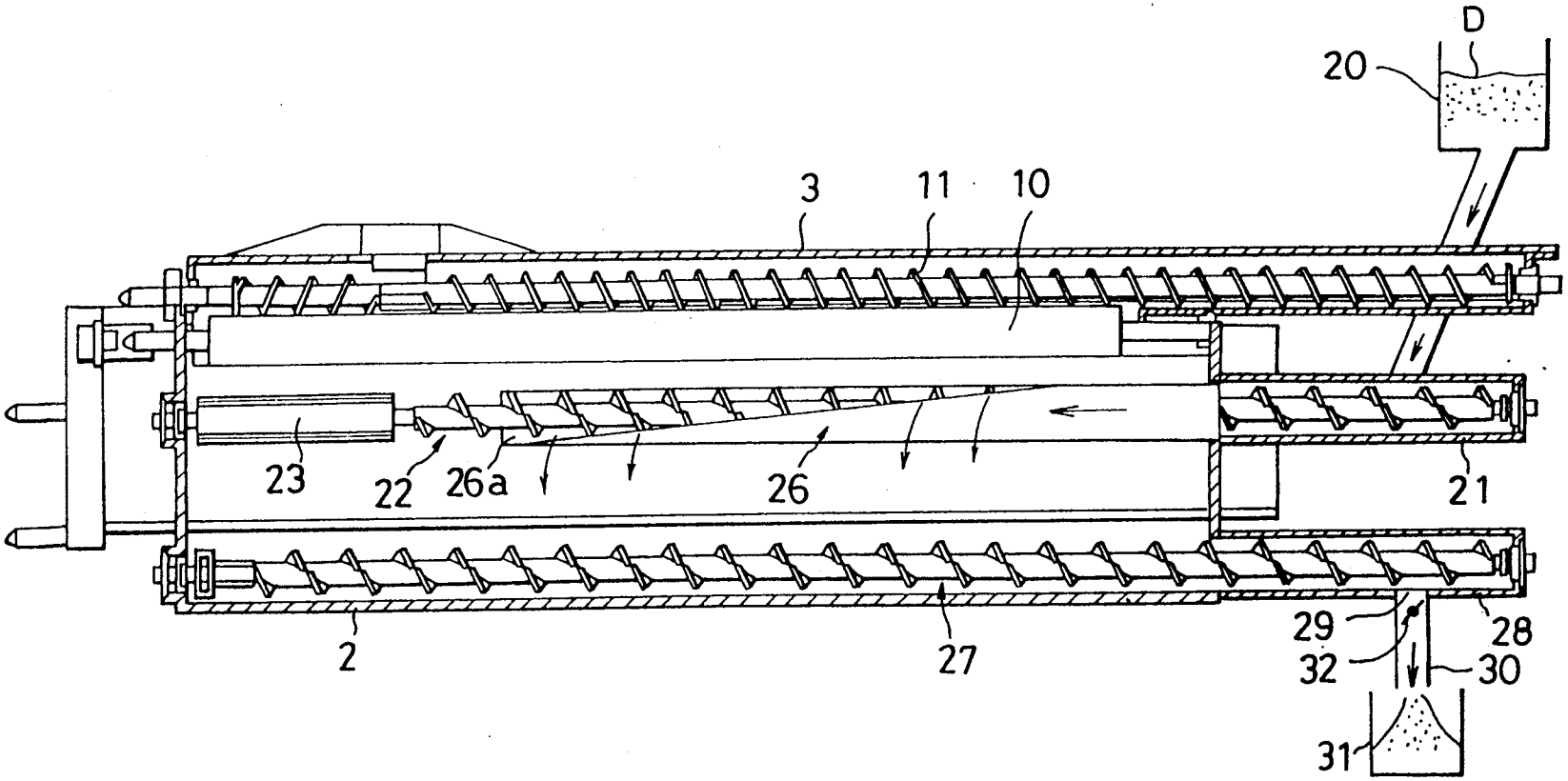
FIG. 8 is a side sectional view showing the developing unit shown in FIG. 7.

As shown in FIGS. 7 and 8, the developing unit according to the related art is constructed to have a developing bath 2 located as opposed to a photosensitive body and a toner feeding bath 3 mounted above the developing bath 2. The developing bath 2 includes a magnet roller 4 and a stirring roller 5 rotatably fitted fitted therein. The toner feeding bath 3 includes a toner feeding roller 10 and toner carrying screws 11 rotatably fitted therein.

The developing bath 2 is communicated with the toner feeding bath 2 through a toner feeding outlet 2*a*. Below the toner feeding outlet 2*a* of the developing bath 2, there is rotatably provided a carrying screw 22.

One side of the carrying screw 22 is fitted to the inside of a cylinder 24 projected on the developing bath 2. The cylinder 24 has a developing powder feeding outlet formed thereon. The feeding outlet is connected to a feeding bath 20 through a pipe.

The carrying screw 22 has an agitator 23 formed at the other side. Around the carrying screw 22 is located a U-character carrying path 26. The carrying path 26 has an opening 26*a* directed upwardly and progressively expanded from the one side to the other side.

In a concave formed on the bottom of the developing bath 2, an exhausting screw 27 is rotatably provided. The exhausting screw 27 is fitted to the inside of a cylinder 28 whose one side is projected on the developing bath 2. On the cylinder 28 is formed an exhaust outlet 29, which is connected to a waste vessel 31 through a pipe 30.

The exhaust outlet 29 is provided with a shutter 19 which is controlled to close the exhaust outlet 16 when developing an image and to open it when exhausting the developing powder.

Further, in FIG. 7, 9 denotes a doctor, 7 denotes a flow plate, and 8 denotes a toner density sensor.

In the developing unit constructed as above, the stirring roller 5 and the exhausting screw 22 are rotated in a manner that all the developing powder in the developing bath may be stirred and fed to the magnet roller 4.

To exchange the developing powder, the shutter 19 is opened and the exhausting screw 14 is rotated so that the developing powder may drop from the exhaust outlet 16 into the waste vessel 18. Then, the new developing powder D is fed to the developing bath 2 by means of the carrying screw 22.

When developing an image, on the other hand, the developing unit of the related art serves to drive the exhausting screw 14 for stirring the developing powder in the developing bath. As such, the developing powder is carried toward the exhaust outlet 16, so that the developing powder may be concentrated on one side of the carrying screw 8. This results in jamming the developing powder between the shaft of the exhausting screw 14 and its bearing, thereby locking the shaft with its bearing. In this state, the exhausting screw 14 disables to rotate, so that no developing powder is disadvantageously allowed to be exhausted.

To overcome the disadvantage, a technique has been considered where the exhausting screw 14 is stopped when developing an image and is activated only when exhausting the developing powder. With this technique, however, the developing powder is not sufficiently stirred so that it may be pooled in the bottom of the developing bath 2. As another disadvantage, the idle developing powder which is not needed for development may be consumed.

Figure 9:
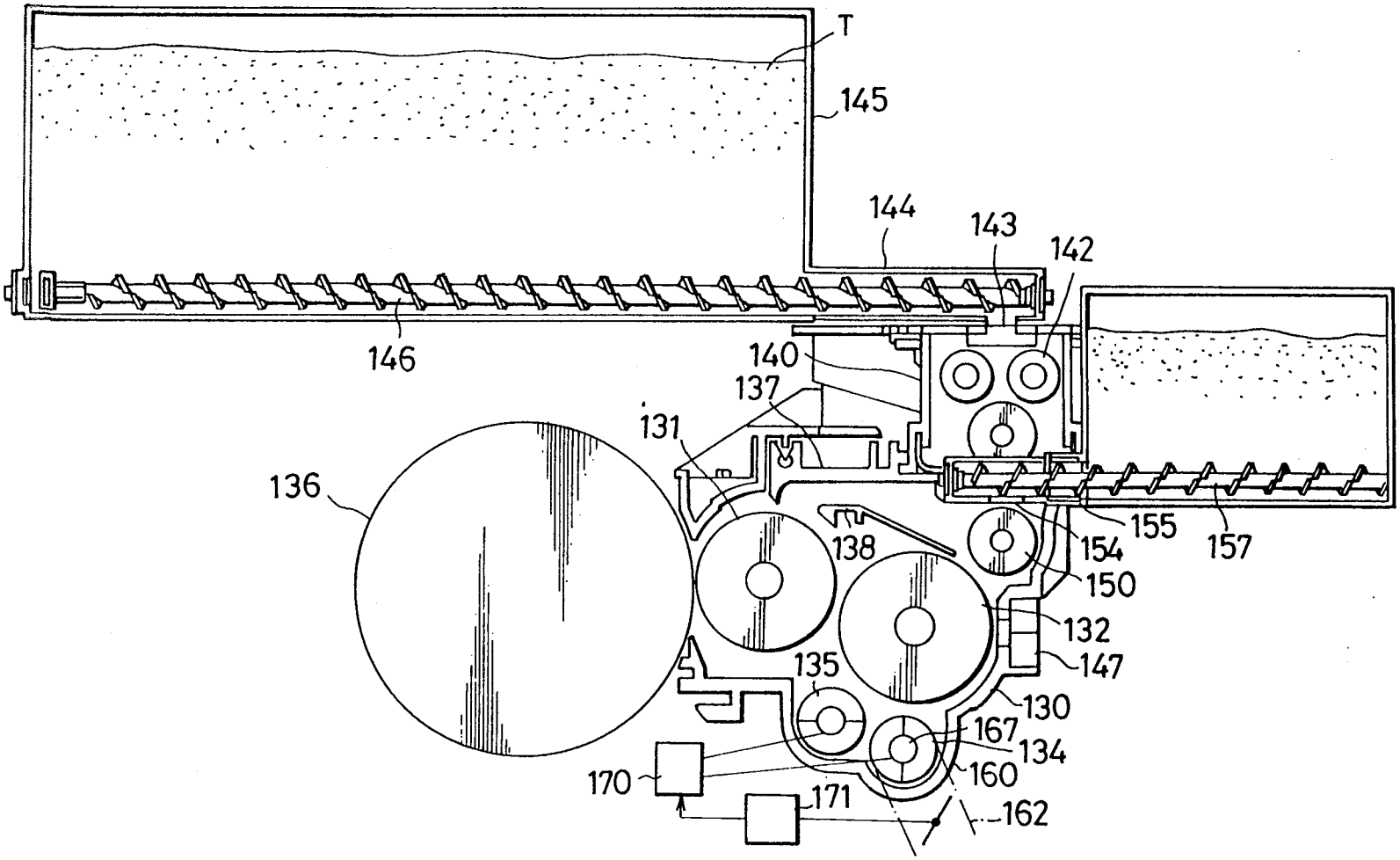
FIG. 9 is a sectional view showing a developing unit according to a second embodiment of the invention.
Figure 10:
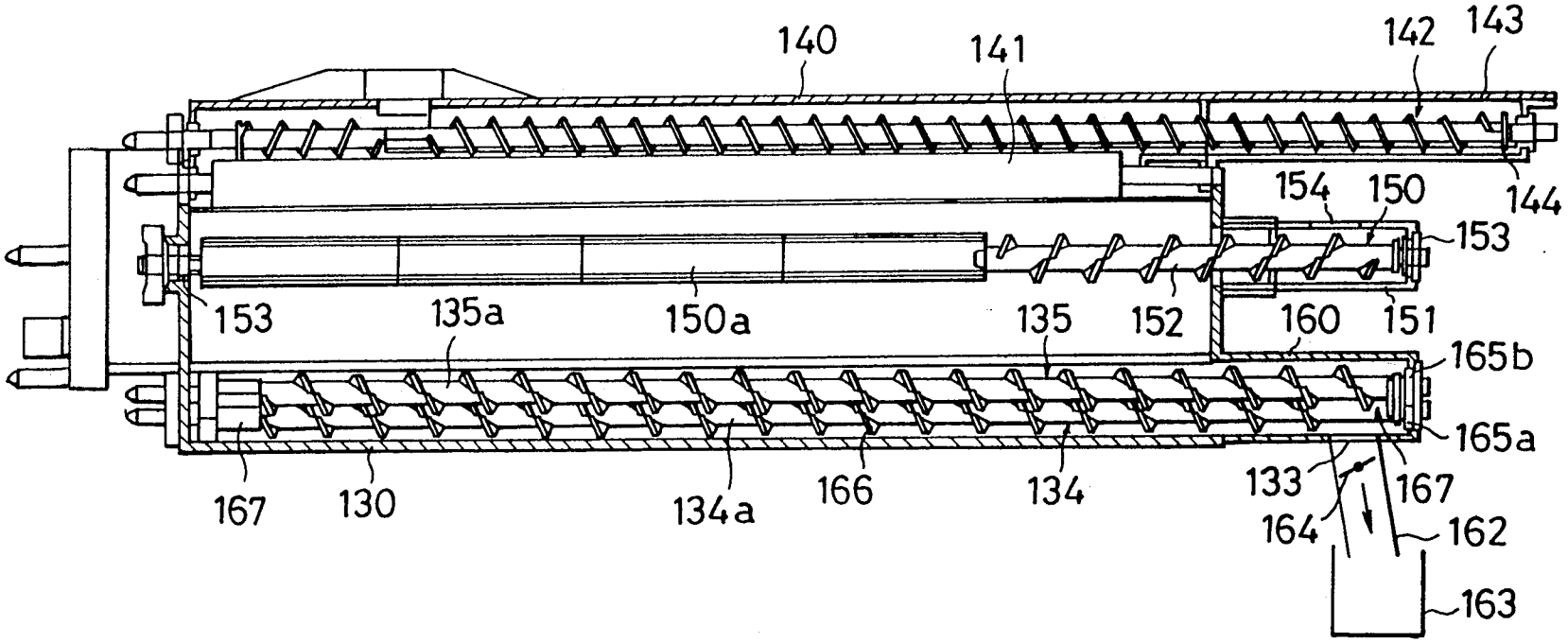
FIG. 10 is a sectional view showing the developing unit shown in FIG. 9.
Figure 11:
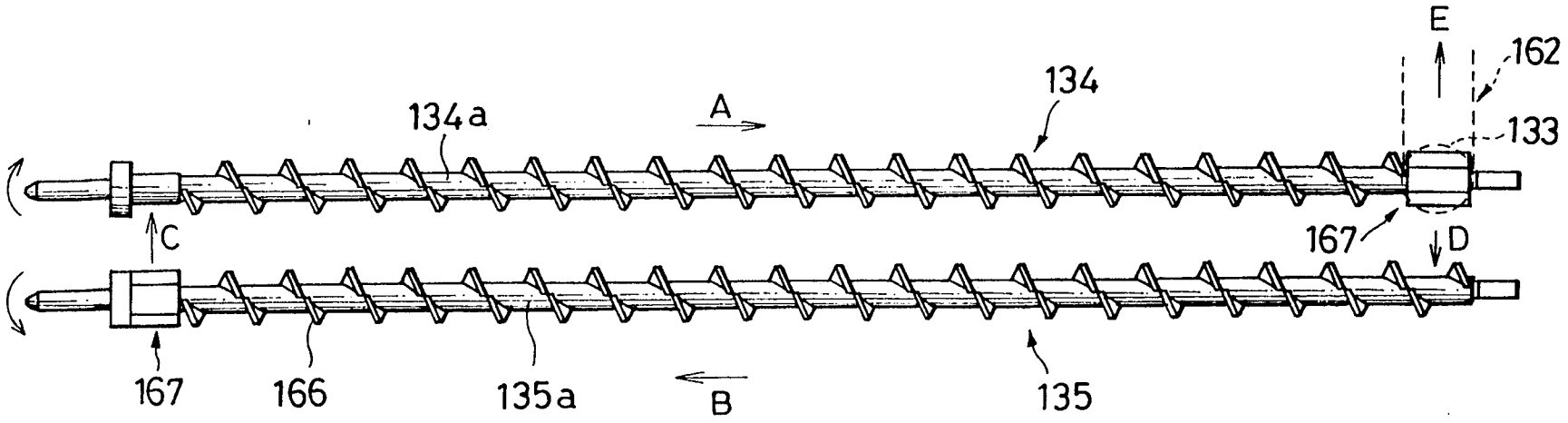
FIG. 11 is a plane view showing a pair of rotary bodies included in the developing unit.

Now, the description will be directed to the developing unit according to the second embodiment as referring to FIGS. 9 to 11. This second embodiment is mainly intended to overcome those disadvantages.

As shown in FIG. 9, the developing unit according to the second embodiment is constructed to have a developing bath 130, a magnet roller 131, and a stirring roller 132, the later two of which are rotatably fitted to the inside of the developing bath 130. On the bottom of the developing bath 130, an exhaust outlet 133 is formed. As a means for exhausting the developing powder out of the developing bath 130 through the exhaust outlet 133, a pair of first and second rotary bodies 134 and 135 are ranged in parallel. Those rotary bodies serve to axially carry the developing powder.

The magnet roller 131 is located as opposed to the photosensitive body 136. The stirring roller 132 is located inside of the developing bath 130 in parallel to the magnet roller 131. Above the magnet roller 131 of the developing bath 130, a doctor 137 is formed. A flow plate 138 is located above the interval between the magnet roller 131 and the stirring roller 132 so that the flow plate 138 serves to move the developing powder restricted by the doctor 137 toward the stirring roller 132.

A toner feeding bath 140 is provided above the stirring-roller side of the developing bath. The toner feeding bath 40 is communicated with the developing bath 130 through a toner feeding outlet. The toner feeding bath 140 provides a toner feeding roller 141 and toner carrying screws 142 rotatably fitted therein. Above the toner feeding bath 140, there is formed a toner feeding outlet 143 which is connected to a toner cartridge 145 through a toner carrying pipe 144.

The toner cartridge 145 is located at the front side of a main body of an image forming apparatus so that the toner T may be more easily filled. The term "front side" means the side directed toward the front door of the main body of the image forming apparatus and as viewed in the right-hand of FIG. 10. A toner feeding screw 146 is rotatably fitted in the lower portion of the toner cartridge 145. One side of the toner feeding screw 146 is fitted into the toner carrying pipe 144 so that the screw 146 serves to carry the toner T to the toner feeding outlet 143.

The toner feeding screw 146, the toner carrying screw 142 and the toner feeding roller 141 are driven in concert by a motor. When a toner density sensor 147 senses that the density of toner contained in the developing powder becomes lower, those components 146, 142 and 141 are driven.

Below a toner feeding outlet of the developing bath 130, there is located a carrying body 150 for carrying the developing powder D lengthwise from the front side to the back side. As shown in FIG. 10, the carrying body 150 has one side formed like a screw and the other side formed to have an agitator 150*a* for stirring the developing powder circumferentially. One side of the carrying body 150 is fitted into the cylinder 151 projected on the developing bath 130. The carrying body 150 has a shaft 152, both ends of which are rotatably supported on the wall of the developing bath 130 and the end of the cylinder 151 through a bearing 153.

A developing powder feeding outlet 154 is formed on the upper portion of the cylinder 151. The outlet 154 is connected to a developing powder feeding bath 156 through a carrying pipe 155. The developing powder feeding bath 156 is located on the front side of the main body of the image forming apparatus so that the filling of the developing powder may be made easier. A carrying screw 157 is rotatably fitted in the lower portion of the feeding bath 156 and the carrying pipe 155. The carrying screw 157 is driven by a motor.

On the bottom of the developing bath 130 is formed a concave portion 160, which is connected with an exhaust cylinder 161 provided on the front side of the main body of the image forming apparatus. The exhaust outlet 133 is communicated with the recovery vessel 163 through the exhaust pipe 162. The recovery vessel 163 is located on the front side of the main body of the image forming apparatus so that the waste vessel 163 may be more easily removed for exhausting the waste developing powder. A shutter 164 is rotatably provided in the exhaust pipe 162. The shutter 164 is activated to open or close the exhaust outlet 133 by means of a motor.

The first and the second rotary bodies 134 and 135 are fitted into the concave portion 160 and the exhaust cylinder 161. The shafts 134*a* and 135*a* are rotatably supported on the wall of the developing bath 130 and the end of the exhaust cylinder through bearings 165*a* and 165*b*, respectively. The first rotary body 134 is located as faced toward the exhaust outlet 133. The second rotary body 135 is located in an obliquely upward of the first rotary body 134.

Each of the rotary bodies 134 and 135 is made of a screw having a spiral fan 166 mounted on each of the shafts 134*a* and 135*a*. Those spiral fans 166 are ranged so as to be directed in the same manner. The front-side end of the first rotary 134 and the back-side end of the second rotary body 135 have fins 167 mounted vertically with the shafts. Those fins 167 serve to carry the developing powder radially.

The magnet roller 131, the stirring roller 132 and the carrying body 150 are rotated through the effect of transmissions driven by a motor located on the back side of the image forming apparatus.

The first and the second rotary bodies 134 and 135 are rotated in an opposite direction to each other by a driving unit 170 composed of a motor and gears.

A control unit 171 is provided on the main body for controlling the motors and the shutter 164. The control unit 171 is composed of a microcomputer.

The control unit 171 provides three main functions, one function of circulating the developing powder by rotating the rollers 131 and 132 and the carrying body 150 and driving the driving unit 170 as keeping the shutter 164 being closed, one function of exhausting the waste developing powder D when a counter sends a signal indicating a predetermined number of counts by rotating the rollers 131 and 132 and the carrying body 150 and driving the driving unit 170 as keeping the shutter 164 open, and the other function of feeding new developing powder by rotating the carrying screw 157 after the developing powder is exhausted. The first function, the second function, and the third function are referred to as a developing-powder circulating function, a developing-powder exhausting function and a developing-powder feeding function, respectively.

The developing-powder circulating function is activated by turning on a start key. The developing-powder exhausting function is activated by turning on an operation key.

In the foregoing construction, when developing an image, the magnet roller 131, the stirring roller 132 and the carrying body 150 and the first and the second rotary bodies 134 and 135 are rotated. At this time, the shutter 164 is kept closed so that the exhaust outlet 133 may be closed.

The developing powder is stirred by the stirring roller 132 and the carrying body 150. In the lower portion of the developing bath 130, the first rotary body 134 serves to travel the developing powder toward an arrow A shown in FIG. 11. The developing powder carried to the front side of the main body is transferred radially by means of the fin 167 of the first rotary body 134.

The developing powder transferred toward an arrow D is then transferred toward an arrow B by means of the second rotary body 135. Next, the developing powder is transferred radially again by means of the fin 167 of the second rotary body 135. The developing powder transferred toward the arrow C is axially carried by the first rotary body 134. As such, the developing powder is vertically stirred by the stirring roller 150 as it is kept constantly circulated.

The control unit 171 determines if the developing powder is waste on the number of counts sent from the counter and displays a message about the necessity to exchange the developing powder.

With the operation key being turned on, the magnet roller 131, the stirring roller 132 and the carrying body 150 are rotated in concert. At a time, the first and the second rotary bodies 134 and 135 are rotated as well. The shutter 164 is opened so as to keep the exhaust outlet 133 open.

The developing powder is carried toward the arrow A by means of the first rotary body 134. When it reaches the front side, the developing powder drops from the exhaust outlet 133 into the exhaust pipe 162. That is, the waste developing powder is guided from the exhaust outlet 133 to the recovery vessel 163 without having to keep the developing powder circulated.

Upon the termination of recovering the waste developing powder, the shutter 164 is closed so that the exhaust outlet 133 is closed as well. To feed the new developing powder D, the carrying screw 157 is rotated so that the developing powder flows from the feeding bath 156 to the cylinder 155 and then drops from the feeding outlet 154 into the developing bath 130. The developing powder fed in the developing bath 130 is radially diffused within the developing bath 130 by means of the carrying body 150.

Unlike the foregoing related art, therefore, the rotary bodies are allowed to rotate in any case, though the related art allows them to be rotated only when exhausting the developing powder. As such, the developing powder is uniformly stirred. This means the stirring efficiency is improved, resulting in enhancing the quality of a copied image.

Since the rotary bodies keep the developing powder circulated, it is possible to prevent their bearings from being locked by the jammed developing powder. This makes it possible to smoothly exhaust the developing powder.

In this embodiment, to circulate the developing powder two same directional screws rotated in different directions are employed. However, two different directional screws rotated in the same direction may be employed to circulate the developing powder.

Many widely different embodiments of the present invention may be constructed without departing from the spirit and scope of the present invention. It should be understood that the present invention is not limited to the specific embodiments described in the specification, except as defined in the appended claims.

What is claimed is:

1. A developing unit comprising:

a developing bath having an exhaust outlet formed on a bottom thereof;

one or more rollers disposed in said developing bath for development;

means disposed in said developing bath below said rollers for exhausting developing powder out of said developing bath through said exhaust outlet;

a shielding member for selectively shielding said exhausting means from said developing bath or exposing said means to said developing bath; and a control unit for controlling said rollers, said exhausting means and said shielding body;

said control unit having means for driving said rollers when exhausting the developing powder and means for driving said shielding member in a manner to expose said exhausting means to said developing bath after an elapse of a certain time from an initiation of driving the rollers, while driving said exhausting means.

2. A developing unit as claimed in claim 1, wherein said exhausting means is an exhausting screw for conveying the developing powder toward the exhaust outlet.

3. A developing unit as claimed in claim 1, wherein said shielding member is a long plate formed in an arc and provided with a hole for passing the developing powder.

4. A developing unit comprising:

a developing bath having an exhaust outlet formed on a bottom thereof;

one or more rollers for development being rotatably fitted to the inside of said developing bath;

means for exhausting developing powder out of said developing bath through said exhaust outlet, said exhausting means providing a pair of rotary bodies for carrying the developing powder axially, one rotary body carrying the developing powder in an opposite direction to the other rotary body and facing said exhaust outlet;

means for selectively opening or closing said exhaust outlet;

means for driving said rotary bodies; and means for controlling said opening or closing means and said driving means, said controlling means being arranged to have means for activating said opening or closing means into an open state and driving said driving means when exhausting the developing powder and means for activating said opening or closing means into a closed state and driving said driving means to circulate and store the developing powder at any time except when exhausting the developing powder.

5. A developing unit as claimed in claim 4, wherein said rotary body has one carrying member at one end on the carrying-directional side, said carrying member serving to radially carry the developing powder and keep it circulated.

6. A developing unit as claimed in claim 4, wherein each of said rotary bodies is formed like a screw and one rotary body has the same directional screw as the other for causing one rotary body to rotate in an opposite direction to the other rotary body.

7. A developing unit as claimed in claim 4, wherein each of said rotary bodies is formed like a screw and one rotary body has the different directional screw from the other rotary body for causing one rotary body to rotate in the same direction as the other rotary body.

* * * * *